US008192566B2

(12) United States Patent
Dulcetti et al.

(10) Patent No.: US 8,192,566 B2
(45) Date of Patent: Jun. 5, 2012

(54) ANNEALING AND PICKLING PROCESS

(75) Inventors: Alessandro Dulcetti, Rome (IT); Milorad Pavlicevic, Udine (IT); Nicoletta Zacchetti, Rome (IT); Alessandra Primavera, Faedis (IT); Stefano Luperi, Pomezia (IT); Luca Lattanzi, Ocre (IT); Simone Guanin, San Pier D'Isonzo (IT)

(73) Assignees: Danieli & C. Officine Meccaniche S.p.A., Buttrio (IT); Centro Sviluppo Materiali S.p.A., Rome (IT)

( * ) Notice: Subject to any disclaimer, the term of this patent is extended or adjusted under 35 U.S.C. 154(b) by 277 days.

(21) Appl. No.: 12/312,482

(22) PCT Filed: Nov. 14, 2007

(86) PCT No.: PCT/EP2007/062319

§ 371 (c)(1),
(2), (4) Date: May 12, 2009

(87) PCT Pub. No.: WO2008/058986

PCT Pub. Date: May 22, 2008

(65) Prior Publication Data

US 2010/0065167 A1 Mar. 18, 2010

(30) Foreign Application Priority Data

Nov. 14, 2006 (IT) ..... MI2006A2187

(51) Int. Cl.

| | |
|---|---|
| ***C21D 1/613*** | (2006.01) |
| *C21D 6/00* | (2006.01) |
| *C21D 8/02* | (2006.01) |

(52) U.S. Cl. ..... 148/634; 148/633; 148/661

(58) Field of Classification Search ..... 148/633, 148/634, 661

See application file for complete search history.

(56) References Cited

U.S. PATENT DOCUMENTS 4,397,451 A * 8/1983 Kinoshita et al. ..... 266/252
4,713,154 A 12/1987 Ohta et al.

FOREIGN PATENT DOCUMENTS

| | | | |
|---|---|---|---|
| JP | 55076014 A | * | 6/1980 |
| JP | 56081629 | | 3/1981 |
| JP | 03079795 | | 4/1991 |
| JP | 03079796 | | 4/1991 |
| JP | 03079797 | | 4/1991 |

* cited by examiner

*Primary Examiner* — Jessica L Ward
*Assistant Examiner* — Alexander Polyansky
(74) *Attorney, Agent, or Firm* — Stetina Brunda Garred & Brucker

(57) ABSTRACT

A continuous annealing and pickling process of flat cold-rolled products, such as stainless steel strips, to obtain a high surface quality product at high production rates and with a low environmental impact. It comprises the following steps: heating, up to a temperature comprised in the range 650-1050° C., in an atmosphere with an oxygen content comprised in the range from 0.5 to 12%; heating for a time comprised from 10 to 200 sec up to a temperature comprised in the range from 650 to 1200° C. in presence of oxidizing agents and/or inert agents; cooling down to temperatures comprised in the range from 650° C. to ambient temperature in presence of oxidizing agents and/or inert agents; thermo-chemical or electrolytic descaling and finally possible pickling and/or passivation, by means of the use of pickling baths consisting of mineral acid solutions.

18 Claims, 1 Drawing Sheet

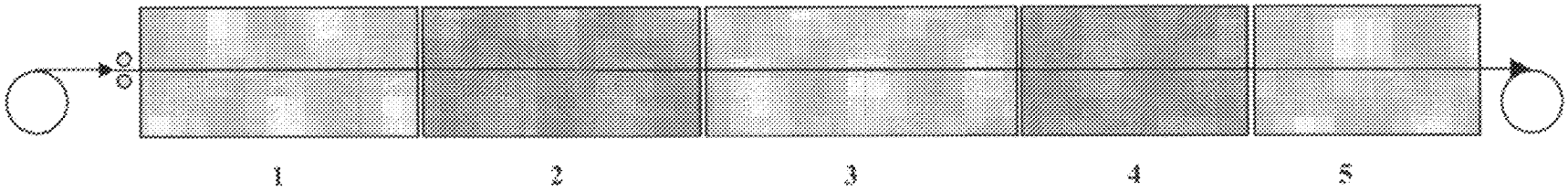
0
0
1
2
3
4
5

ANNEALING AND PICKLING PROCESS

FIELD OF THE INVENTION

The present invention relates to a continuous annealing and pickling process of flat rolled products, specifically to an annealing and pickling process of cold-rolled stainless steel strips.

STATE OF THE ART

The production cycle of flat rolled stainless steel sections contemplates various mechanical treatment steps, such as rolling, thermal treatment steps, such as annealing, and surface treatment steps, such as descaling, pickling, passivation and finishing.

After hot-rolling, a stainless steel strip is firstly annealed to allow the solubilization of chromium carbides and the re-crystallisation of the material, then pickled to remove scale from the surface and finally cold-rolled to reach the final required thickness. The annealing and pickling treatments of hot-rolled sections are usually performed on continuous annealing and pickling lines, sometimes capable of also processing cold-rolled sections. The cold-rolling treatment of strips generally contemplates final thickness reductions from 20% to 85% by means of a sequence of rolling steps. The final roughness of the surface of the cold-rolled sections is comprised from 0.01 to 0.50 μm.

The stainless steel strip is then subjected to a further thermal treatment cycle, during which there are provided the processes of re-crystallisation and grain growth, which is aimed at conferring to the final product the required mechanical features, e.g. those contemplated by standard EN 10088.

This further thermal treatment is performed:

- either in furnaces operating in a reducing atmosphere, containing mixtures of $H_2$—$N_2$, in the so-called Bright Annealing lines, or simply BA lines, obtaining a surface with a highly reflective final finish, corresponding to a 2R finish according to the Standard EN10088/1-2, generally having a percentage of reflected light at 60° as for the AISI304 higher than 50%, with roughness comprised from 0.01 to 0.10 μm;
- or in furnaces operating in oxidising atmosphere in Continuous Annealing and Pickling Lines, or simply CA&PLs, obtaining a surface with dull final finish, corresponding to a 2D and 2B finish according to the Standard EN10088/1-2, having a percentage of reflected light at 60° C. as for the AISI304 lower than 30%. The BA lines are always provided, before the thermal treatment section, with a degreasing section. Such section, not always present in CA&PLs, by means of a sequence of chemical treatments, e.g. with soda and/or potassium carbonate and surfactants, or of electrolytic treatments, supported by the action of cleaning and washing of brushes, allows to remove rolling oil residues from the surface of the cold-rolled strips. The control of the surface state of the strip at furnace entrance in BA lines, both in terms of roughness and residual oil, is indeed a fundamental prerequisite for obtaining final surfaces of homogenous and highly reflecting appearance.

A cooling section for cooling the strip, from the maximum temperature reached in the furnace down to temperatures lower than 80° C., is always present downstream of the section of said further thermal treatment, on both CA&P lines and on BA lines.

In the cooling section of the CA&PLs, air or preferably $O_2$ content controlled atmosphere jet-coolers are normally used up to temperatures of the strip of approximately 750-650° C. An intermediate air cooling down to approximately 250° C. and a final water cooling down to temperatures lower than 80° C. follow.

In BA lines, the strip is cooled with jet-coolers in $H_2/N_2$ atmosphere up to the final temperature lower than approximately 100° C.

In conventional lines, both BA and CA&PLs, the cooling rate is higher than 15-20° C./s to avoid phenomena of chromium carbide precipitation at the grain boundaries which make the steel sensitive to the so-called intergranular corrosion. The introduction of cooling gas is dimensioned and adjusted to also ensure the required planarity of the strips, specifically the thin ones.

The strip and its support during all steps of the treatment are typically conveyed by means of conveying systems, generally roller systems, which come into contact with the surface of the strip. In BA lines the contact of the strip, at high temperatures, with the surface of said systems is avoided in order to prevent surface defects. Furthermore, in BA lines the safety constraints deriving from the use of atmospheres containing high quantities of $H_2$, for which the possibility of contact with air must be prevented, determine the convenience of excluding any strip conveying system of the roller type within the heating furnace, imposing in fact the use of exclusively vertical closed annealing furnaces for this type of process.

Therefore the BA lines typically consist of vertically developed heating and cooling sections, in which the strip undergoes the heating and cooling treatments moving always in vertical direction, without the need for conveying systems and/or support in contact with the strip when this is at high temperatures. Furthermore, at high temperature, the intrinsic mechanical features of the flat rolled stainless steel sections, e.g. the tensile yield stress, and of the metallic structures of the furnaces themselves limit the maximum reachable height of the BA lines and consequently the maximum reachable production rate, which is thus generally no higher than 20 tons/h, considerably lower than that of CA&PLs, which is generally comprised from 50 to 150 tons/h. Bright Annealing lines thus allow to obtain a strip surface with final finish having a higher reflectivity with respect to CA&PLs but display, with respect to the latter, a lower production rate and higher costs.

The annealing thermal treatment, performed in oxidising atmosphere (CA&PLs), causes the formation, on the strip surface, of a layer of oxides and a layer of dechromized steel underneath, i. e. chromium-depleted steel. Both layers are then removed in appropriate manner to impart the required final surface features to the material. The thermal treatment is thus followed by a further sequence of chemical and electrochemical treatments of descaling, pickling and passivation, which aim at obtaining a finished product characterised by an oxide-free surface and, in general principle, dull, hence the name "2D" (according to the Standard EN 10088) wherein D stands for "dull".

The pickling systems for cold-rolled product processing lines normally consist of a descaling section, a pickling section and a passivation section.

In the descaling section, the scale formed during the annealing process is conditioned and partially removed facilitating the intervention of the downstream removal processes. The cold-rolled strip descaling technologies normally used are either of the thermochemical type, using oxidising dissolved salt baths, e.g. kolene (eutectic mixture of NaOH, $NaNO_3$, NaCl), or of the electrolytic type, using both neutral sodium sulphate solutions and acid solutions. Both the chemical technologies in dissolved salt baths and the electrolytic technologies perform a selective oxidation of the chromium present in the oxide making it soluble in the bath. A method for obtaining electrochemically said descaling treatment is described in WO02/086199 in which the density of applied current and the specific electric charge transferred to the strip are correlated to the features of the oxide to be removed.

In the pickling chemical section the dechromized steel layer, formed during annealing, is removed and the removal of the oxide layer, anchored to it, is completed by means of the action of acid baths having a high oxidising capacity and formed by mixtures of mineral acids. The most commonly used baths are mixtures of mineral acids, such as: $HNO_3$—HF, at temperatures from 25 to 70° C., and mixtures of $H_2SO_4$—HF, with the addition of oxidising agents and operated at temperatures from 25 to 70° C., as for example described in EP1490531.

The final passivation treatment leads to the formation, on the surface of the finished product, of the necessary protective passivation film. Said action is generally obtained by means of high redox potential baths, when not performed at the same time as the pickling action.

In CA&P lines, the behaviour of the material surface to the descaling, pickling and finishing/passivation treatment depends on the features of the oxide layer and on entity of the layer of dechromized steel underneath. Such features are affected by the type of material, the chemical composition of the steel (content of Cr, Ni, Mn, Si, etc.), the thermal cycle undergone by the strip (in terms of maximum reached temperature, permanence time over a determined temperature, heating and cooling rates) and the chemical composition of the atmosphere in the furnace (concentration of oxidising agents $O_2$, $H_2O$ and $CO_2$).

Methods and techniques have been developed for controlling the annealing process, for increasing the pickling potential of products or for reducing costs and improving surface quality.

U.S. Pat. No. 4,713,157 describes a process and the related apparatus in which, in order to reduce the thickness of the oxide layer and favour its pickling potential, the strip is annealed in sealed furnaces, horizontally or vertically developed, in which the atmosphere is formed by nitrogen and hydrogen with concentration of the latter comprised from 3 to 15%.

In said furnaces the strip remains for a time such that the entire annealing and cooling cycle is carried out in atmosphere of $N_2$—$H_2$, said strip following internal horizontal and/or vertical paths, being guided by a complex support roller system. The subsequent pickling occurs in electrolytic cells containing nitric acid.

JP5222449 describes a process for controlling the structure and the thickness of the oxide film which is generated during the annealing process for improving the pickling properties and the surface quality of the cold-rolled Fe—Cr or Fe—Cr—Ni stainless steels. The combustion gas atmosphere is controlled, specifically the content of $O_2$ is set to values of <1% when the strip temperature is <600° C. for Fe—Cr steels and <800° C. for Fe—Cr—Ni steels, while over 600° C. for Fe—Cr steels and 800° C. for Fe—Cr—Ni steels the $O_2$ concentration is set to values comprised from 1% to 10% up to the maximum annealing temperature.

In annealing furnaces the heat exchange phenomena prevalently occur by irradiation between the walls of the furnace and the surface of the rolled strip, thus the heating rate of the strips of equal thickness depends on the zone temperature in that segment of the furnace. Considering that usually the furnace zone temperatures do not exceed 1200-1250° C. and considering the emissivity values of stainless steel strips, comprised from 0.25 to 0.45 according to the input surface state, the temperature, the type of steel, etc., the average thermal flow received by the strip is generally comprised from 10 to 65 $kW/m^2$ for each face of the strip and generally does not exceed 70 $kW/m^2$. Consequently, the heating rate of 1 mm thick strips is generally comprised from 25 to 35° C./s and does not exceed 40° C./s.

The atmosphere in the CA&PL burner furnaces is essentially regulated/controlled by acting on the supporter of combustion/fuel ratio (A) in the burners and appears formed by different oxidising species: carbon dioxide, aqueous vapour and quantities of oxygen in excess with respect to stoichiometric combustion $\lambda>1$. Usually, the ratio $\lambda$ is set to obtain an excess of $O_2$ equal to 2-5% for austenitic stainless steels and equal to 4-10% for ferritic stainless steels.

For example, a 1 mm thick strip of AISI 304 annealed with a standard thermal cycle which allows to obtain the required mechanical properties (ref. EN10088), with maximum temperature of 1110° C. and permanence time of 60 seconds, and with an $O_2$ content in atmosphere of 3-5%, is characterised by an oxide layer generally comprised from 300 to 400 nm, formed by mixed chromium, iron, manganese and silicon oxide. Specifically, starting from the interface with the matrix, the oxide is characterised by a first slightly Si enriched layer, by a subsequent Cr enriched layer and by an external mixed Cr and Fe layer enriched with Mn.

Disadvantageously, the removal of the oxide layer and of the dechromized steel layer underneath, which occurs in the descaling, pickling and finishing/passivation sections due to the action of the acid pickling baths, causes a chemical etching on the surfaces determining the loss of the reflectivity features proper of the rolled product.

Furthermore, said dissolution leads to the formation of high environmental impact chemical reaction products both in gaseous phase, such as fumes or acid bath vapours, and in liquid phase, such as exhausted treatment solutions and wash water. The hourly quantities of said reaction products are directly proportional to the specified quantity, per area unit, of removed oxide and dechromized steel. It is thus required to make a further treatment section, auxiliary to the descaling, pickling and finishing/passivation sections, dedicated to the neutralisation/laying of the aforesaid chemical reaction products, with increased times and production costs.

It is thus felt the need to make an annealing and pickling process which allows to overcome the aforesaid drawbacks.

SUMMARY OF THE INVENTION

It is the primary object of the present invention to make a continuous annealing and pickling process of flat cold-rolled products, such as stainless steel strips, which allows to obtain a high surface quality product at high production rates.

It is a further object to make a continuous annealing and pickling process capable of minimising the environmental impact, specifically with respect to that of CA&PLs, without increased costs either for plant or process.

The present invention thus aims to solve the above discussed problems by making a continuous annealing and pickling process for flat cold-rolled stainless steel products of thickness comprised from 0.3 to 4 mm, having surface roughness Ra<0.50 μm, possibly degreased, which, in accordance with claim 1, implements the integration and continuity of the following steps:

a first heating step up to a temperature comprised in the 650-1050° C. range by means of an average thermal flow comprised from 15 to 300 kW/m$^2$ received by each face of the strip, in an atmosphere with an oxygen content from 0.5 to 12%;

a second heating step lasting from 10 to 200 sec up to a temperature comprised in the range from 650 to 1200° C. in presence of oxidising agents and/or inert agents or, alternatively, in presence of inert agents and/or reducing agents;

at least one cooling step down to temperatures comprised in the range from 650° C. to ambient temperature in presence of oxidising agents and/or insert agents or, alternatively, in presence of inert agents and/or reducing agents;

at least one thermochemical or electrolytic descaling step;

a possible pickling and/or passivation step by means of the use of pickling baths formed by mineral acid solutions, possibly with HF, the latter in concentration comprised from 0 to 45 g/l at temperature comprised from 25 to 70° C.

In a preferred embodiment of the process according to the invention, in the second heating step and in the cooling step, the oxidising agents are selected from $O_2$, $H_2O$ and $CO_2$, the inert agents are formed by $N_2$ and the reducing agents are formed by $H_2$.

Advantageously, the process of the present invention allows to obtain products of higher surface quality with respect to that obtainable with the conventional annealing and pickling lines (CA&PL) and tending to the surface quality obtained with Bright Annealing (BA) lines. The obtained surface reflectivity, measured as percentage of the light reflected at an angle of 60° with respect to the vertical of the surface, tends to be that of the material obtained by a BA process, for example higher than 50% for AISI 304 type austenitic steels.

The present invention also allows to obtain a further significant advantage in terms of cost reduction for the production of high surface quality strips. Indeed, such process has a productivity similar with respect to that of the conventional continuous treatment lines and thus considerably higher with respect to that obtainable in BA lines due to the known constraints related to vertical development.

Specifically, the process described in the present invention determines the formation, during the annealing step, of a layer of oxide which displays:

a considerably lower thickness with respect to that which is obtained in the conventional annealing procedures described in the state of the art;

a higher percentage content of Cr, i.e. a higher Cr/Fe ratio in the oxide, with respect to that which is obtained in conventional annealing in order to make removal easier during both electrolytic and thermochemical descaling treatments;

a thin layer of dechromized steel underneath for whose removal a chemical pickling which does not etch the material surface, with negative incidence on the surface quality, is sufficient.

The reduction of the environmental impact advantageously derives from the lower consumption of acids per area unit of processed strip. This occurs by effect of the reduction of the amount of steel to be dissolved during the pickling step, being the layer of oxide and of dechromized steel to be removed smaller with respect to that produced during the conventional annealing procedures.

The stainless steels treatable with the process of the invention are all those produced in the form of cold-rolled sections, including, for example:

austenitic steels of the AISI 304, 301, 305, 316, 321, 347, 309, 310 types;

ferritic steels of the AISI 430, 409, 439, 441, 444 types;

martensitic steels of the AISI 410, 420 types;

duplex steels of the 2205, 2304 types.

The dependent claims describe preferred embodiments of the invention.

BRIEF DESCRIPTION OF THE DRAWING

Further features and advantages of the present invention will be more apparent in view of the detailed description of preferred, but not exclusive, embodiments of an annealing and pickling process of stainless steel cold-rolled strips, illustrated by way of non-limitative example, with the help of the accompanying drawing, in which:

FIG. 1 depicts the layout of a plant in which the annealing and pickling process of the invention is performed.

DESCRIPTION OF THE INVENTION

The process object of the present invention is applied to a product, stainless steel cold-rolled strip of thickness comprised from 0.3 to 4 mm, having the following surface features: roughness Ra<0.50 μm and preferably Ra<0.10 μm and possibly degreased.

The continuous annealing and pickling process of flat cold-rolled stainless steel products, object of the present invention, implements the continuity and integration of the steps described below preferably starting from strips with the aforesaid features of roughness and surface cleanness.

The first two steps of the process contemplate the thermal annealing treatment for the re-crystallisation and crystal grain growth process so as to reach the contemplated mechanical properties, e.g. as established by the Standard EN 10088

Advantageously, such annealing treatment, by means of a predetermined and controlled oxidation, causes on the strip surface the formation of a layer of oxides and a layer of dechromized steel underneath, both layers being easily removable by means of a subsequent pickling treatment.

This annealing treatment is performed in at least two consecutive steps, as shown below:

a first heating of the strip up to a temperature of 650-1050° C., according to the considered class of stainless steel, conducted so as to be able to condition and control the nucleation and selective growth steps of a chromium-rich oxide;

a second heating of the strip up to the maximum temperature for completing the aforesaid metallurgic transformations.

The first heating produces an oxide suitable to limit the oxidation during the subsequent step and easily conditionable/removable during the subsequent cooling, descaling, pickling and finishing treatments.

The parameters controlling this first oxidation step are the content of oxygen in the annealing atmosphere, variable from 0.5 to 12%, and the heating rate of the strip whereby the average thermal flow, which the strip must receive on each face, must be comprised from 15 to 300 kW/m$^2$.

According to the present invention, the first heating of the strip, up to 650-1050° C., is preferably conducted, for a strip of thickness comprised from 0.8 to 3.5 mm with an average thermal flow received by the strip, on each face, from 120 to 300 kW/m$^2$ and concentrations of $O_2$ from 0.5% and 5%, so as to favour the formation of a layer of oxide which is advantageously 30% thinner than that obtainable with the conventional procedures up to the maximum temperature contemplated for this process step.

For a strip of thickness comprised from 0.3 to 2.0 mm, the first heating step up to -650-1050° C. is performed by means of an average thermal flow, received on each face of the strip, comprised in the range from 45 to 175 kW/m$^2$ and of concentrations of $O_2$ comprised from 0.5 to 5%.

This first heating step may occur, preferably up to 600° C., with an average thermal flow on each strip face comprised in the 150-300 kW/m$^2$ range. This first heating may be performed by means of a first heating section provided with heating systems, e.g. constituted by burners of the conventional type and/or of the flameless type and/or of the flame impingement type, also of the self-recovery type and/or self-regenerating type, operated on natural gas and/or methane and/or LPG and using air, enriched air or pure oxygen or mixtures thereof as supporter of combustion. The air is preheated up to a temperature of 650° C. and/or enriched with oxygen up to concentrations of 31% and/or pure oxygen. Said first heating section is preferably provided with refractory materials suitable for continuous operation at temperatures also up to 1500° C. The content of oxygen in the treatment atmosphere, desired for the purposes of the process, will be ensured/controlled by direct feeding systems for feeding the furnace, at controllable flow rate, with possibly enriched air or oxygen, and preferably by controlling the combustion ratio to the burner. Such direct feeding systems may comprise lances, slots, distributors or other suitable systems. During this heating step, the content of $O_2$ in the atmosphere is measured preferably at a distance from the surface of the strip comprised from 50 to 200 mm.

The second heating step, in order to condition/limit the growth of the oxide layer, provides a control of the reactivity of the annealing gaseous atmosphere by acting on the presence of agents, such as $O_2$, $H_2O$ and $CO_2$, and preferably by operating with inert atmosphere, e.g. $N_2$, whose dew temperature is comprised from −60 and 10° C. or reducing atmosphere, e.g. $N_2$ and $H_2$, in which case concentrations respectively from 0 to 98% and from 100 to 2% are used whose dew temperature is from −30 to 10° C.

Such second heating of the strip is obtained in a second dedicated heating section, possibly fluid-dynamically separate from the first one by means of a gas seal to prevent reintroductions of external air, that may be provided with burners of the above-mentioned type or, alternatively, provided with heating systems with electrical resistors or radiating tubes. The oxygen content in the atmosphere is controlled by suitably acting on the air-gas ratio, in the case of heating by means of burners, or by means of appropriate feeding and exhaust systems of the gaseous chemical species belonging to the treatment atmosphere.

A third step of the process contemplates a cooling down to ambient temperature in which there is no further growth of the oxide layer formed during the annealing and/or the partial reduction of the iron oxides contained therein. This cooling step is performed in presence of oxidising agents, such as $O_2$, $H_2O$, $CO_2$, and/or inert agents such as $N_2$, or inert agents, such as $N_2$, and/or reducing agents $H_2$.

According to a preferred embodiment of this invention, the cooling step is performed preferably in atmosphere formed by mixtures of $N_2$ and $H_2$ with concentrations of $H_2$ comprised in the 0-50% range with a dew temperature from −60° C. and 10° C.

In a particularly advantageous embodiment, in which an inert atmosphere with $N_2$ is used, the dew temperature is comprised from −30° C. to 10° C.

In a further preferential solution of the patent, the cooling occurs in three steps, i.e.:

- up to a temperature comprised from 750° C. to 500° C. in atmosphere containing mixtures of $N_2$ and $H_2$, with concentrations of $H_2$ comprised in the 0-50% range, with a dew temperature from −60° C. to 10° C.;
- from 750° C.-500° C. up to 300° C.-200° C. by means of air cooling;
- from 300° C.-200° C. up to ambient temperature by means of $H_2O$.

In another preferential solution, the cooling down to 550° C.-450° C. occurs in atmosphere containing mixtures of $N_2$ and $H_2$, with concentrations of $H_2$ comprised in the 0-50% range, with a dew temperature from −60° C. to 10° C.

In all cases, the cooling section is provided with systems for measuring and controlling the composition of said cooling atmosphere. The cooling devices are sealed if $H_2$ is used. The strip may be cooled by means of air, radiating elements, such as water liners, or jet coolers.

The fourth step of the process contemplates at least one thermochemical descaling treatment, by means of the use of dissolved salts, or an electrolytic descaling treatment suitably performed preferably in neutral solution of $Na_2SO_4$, with concentration comprised from 130 to 210 g/l and at temperatures comprised from 40 to 90° C., or in acid solution of $H_2SO_4$, with concentration comprised from 40 to 150 g/l at temperatures comprised from 25 to 50° C.

Alternatively an electrolytic descaling treatment can be performed by using solutions of nitric acid with concentration between 30 and 150 g/l at temperature comprised from 30 to 70° C.

In relation to the specific oxide layer present on the surface of the strip, in terms of thickness and concentration of chromium oxides, such descaling treatment provides a selective oxidation of the chromium present in the oxide making it soluble in the bath determining the preferably complete removal of the layer itself.

A preferred method for the above-mentioned descaling contemplates that the delivered electrical current and the corresponding electrical charge transferred to the strip are related to:

- the features of the oxide to be removed;
- the features of the plant where the descaling is performed (type of solution, length of electrodes which anodically polarise the strip);
- speed at which the strip is processed in the cell.

A possible application of said process contemplates the use of neutral sodium sulphate solutions with concentration equal to 160 g/l at temperature equal to 75° C. and applied current density equal to 8 A/dm$^2$, and a subsequent electrolytic treatment in nitric acid at 50° C. with applied current density equal to 6 A/dm$^2$.

The fifth step of the process contemplates a possible pickling and/or passivation treatment which removes the layer of oxides, possibly residuals after the descaling treatment, and possibly the dechromized layer underneath.

According to the present invention said treatment is performed by means of the use of mineral acid solutions and HF, with HF concentration comprised from 0 to 40 g/l and preferably comprised from 0 to 15 g/l, at temperature comprised from 25 to 70° C. and preferably from 30 to 60° C. A preferred method of the present invention is the use of solutions in which the mineral acid consists of $HNO_3$ with concentration comprised from 40 to 200 g/l and preferably comprised from 100 to 140 g/l. The object of the present invention further includes processes in which the mineral acid is formed by mixtures of acids selected from $HNO_3$, $H_2SO_4$, HCl with concentrations respectively comprised from 20-120 g/l for $HNO_3$, 30-140 g/l for $H_2SO_4$, 40-180 g/l for HCl at temperatures comprised from 25 to 70° C.

Advantageously the latter treatment, with reduced aggressiveness, is such not to produce a strong chemical etching on the surface of the strip and therefore does not affect the reflectivity and the surface features of the surface itself.

For ferritic steels this treatment is preferably made using the nitric acid based pickling solutions described above but totally free from hydrofluoric acid, either free or forming a complex, with temperatures comprised from 25 to 40° C., preferably not higher than 30° C.

In order to obtain a complete separation of the different atmospheres present in the heating and cooling sections, for reasons both of process and of safety, a sealed separation chamber may be provided between the heating and cooling sections. Similarly, a separation chamber may be provided downstream of the cooling section to prevent the contact of potentially flammable gas with the air. Said chamber may be made by means of a siphon with demineralised water or other liquids, such as for example oil, or by means of inert gas.

The main sections forming an annealing and pickling plant for stainless steel cold-rolled strips, in which the innovative process here described is performed for obtaining products with high surface quality tending to that currently produced with the BA process, at lower costs with respect to the BA process and minimising the environmental impact with respect to CA&PLs, are schematically shown in FIG. 1. The reference numerals indicate the various sections in which numeral 1 indicates the strip heating section up to a temperature comprised in the range from 650 to 1050° C., numeral 2 indicates the strip heating section up to a temperature in the range from 650 to 1200° C., numeral 3 indicates the strip cooling section up to a temperature comprised from 650° C. to the temperature in the thermochemical or electrolytic descaling section, numeral 5 indicates the pickling and finishing/passivation section provided with chemical baths.

Second heating section 2, when the use of atmospheres free from $O_2$ and $CO_2$ is contemplated, is provided with heating means, such as: radiating tubes; electrical resistors and/or inductors and/or NIR (near-infrared) heaters.

Cooling section 3 consists of one or more modules using reciprocally different and maintained separate atmospheres.

EXAMPLE 1

This example describes the annealing and pickling process of an austenitic stainless steel strip of the AISI 304 type, 1 mm thick and 1270 mm wide, cold-rolled with a reduction rate of 80%, with a surface roughness (Ra) comprised from 0.08 to 0.10 μm and with an amount of residual rolling oil 510 mg/m$^2$ of strip, said strip having previously being subjected to degreasing in alkaline solution. The strip was processed at a process speed of 130 m/min in a plant schematised in FIG. 1 for a production rate of approximately 78 t/h. According to the present invention, operations were under the following conditions:

- heating the strip up to a temperature of 900° C., in an atmosphere with an oxygen content equal to 1.5% and an average thermal flow on each strip face equal to 85 kW/m$^2$ corresponding to an average heating rate of approximately 40° C./s. Said heating, lasting in total for approximately 22 sec, occurs in a furnace whose internal temperature is averagely 1270° C. Said temperature is reached by means of the use of free flame burners using methane gas as fuel and air as supporter of combustion adjusted in a 10.5:1 (air-gas) combustion ratio;
- heating the strip in the section 2 for 30 s from 900° C. up to the temperature of 1110° C. in a gaseous atmosphere formed by nitrogen. The heating occurs in a furnace heated by means of electrical resistors. The temperature inside the furnace during the treatment is 1170° C.;
- a cooling step with average rate of 20° C./sec up to temperature of at least 80° C. in a nitrogen gaseous atmosphere and having a dew point of <10° C.;
- a first electrolytic descaling step in neutral sodium sulphate solution with concentration of 160±20 g/l;
- a second electrolytic descaling step in nitric acid solution with concentration of 50 g/l at temperature of 40° C.;
- a passivation step with nitric acid solutions, in concentration of 100 g/l at temperature of 40° C.

In such conditions, it was possible to obtain strips with a surface reflectivity measured at an angle of 60° equal to 50% and much higher than that of strips having equal thickness obtainable with conventional process. This is obtained at a considerably higher production rate with respect to that obtainable in plants of the BA type (approximately 20 t/h). The balance of consumptions, per ton of processed steel, related to the acids used for the pickling and passivation step, indicated a decrease in the same acids by approximately 60% with respect to that corresponding to the traditional CA&PLs operated with strips of equal width and thickness, at the same production rate. This further determined an equally considerable decrease of $NO_x$ emissions from the pickling solutions.

Micrographic tests performed on samples of steel, taken at the end of the cooling step, showed the presence of an oxide layer of thickness comprised from 80 to 120 nm which thus appears considerably smaller than that which is obtained in conventional annealing cycles on CA&PLs.

EXAMPLE 2

This example describes the annealing and pickling process of an austenitic stainless steel strip of the AISI 304 type, 1 mm thick and 1520 mm wide, cold-rolled with a reduction rate of 85% and with a surface roughness (Ra) comprised from 0.06 to 0.09 μm. The strip was processed at a process speed of 150 m/min for a production rate of approximately 103 t/h. According to the present invention, operations were under the following conditions:

- heating the strip up to a temperature of 920° C., in an atmosphere with an oxygen content equal to 1% and an average thermal flow on each strip face equal to 100 kW/m$^2$ corresponding to an average heating rate of approximately 50° C./sec. Said heating, lasting in total for approximately 18 sec, occurs in a furnace whose internal temperature is averagely 1340° C. Said temperature is reached by means of the use of free flame burners using methane gas as fuel and air as supporter of combustion adjusted in a 10:1 (air-gas) combustion ratio;
- heating the strip in section 2 for 27 sec from 920° C. up to the temperature of 1120° C. in a gaseous atmosphere containing an oxygen concentration equal to 3%, $CO_2$ approximately 10% and $H_2O$ approximately 15%. Said heating occurs in a furnace whose internal temperature is averagely 1180° C. Said temperature is reached by means of the use of free flame burners using methane gas as fuel and air as combustion supporter adjusted in a 11.5:1 (air-gas) combustion ratio;
- cooling the strip down to a temperature of 80° C. according to the following steps:

Cooling down to 650° C.-550° C. in cooled atmosphere formed by the fumes from the furnace chimney in which the first heating step is performed;

From 650° C.-550° C. down to 300° C.-200° C. by means of jet cooler in air:

From 300° C.-200° C. to 80° C. by immersion in water;

electrolytic descaling in neutral solution of $Na_2SO_4$ with concentration of 180±20 g/l at temperature of 80° C.;

pickling and passivation with nitric acid solutions having concentration of 120±20 g/l, with free HF in concentration of 10 g/l at temperature of 60° C.

In such conditions, with a more aggressive pickling with respect to that of the previous example, it was possible to obtain strips with a surface reflectivity measured at an angle of 60° equal to 42% and higher than that of strips having equal thickness obtainable with conventional process. This is obtained at a considerably higher production rate with respect to that obtainable in plants of the BA type (approximately 20 t/h). The balance of consumptions, per ton of processed steel, related to the acids used for the pickling and passivation step, indicated a reduction of the same acids by approximately 40% with respect to that corresponding to the traditional CA&PLs operated with strips of equal width and thickness, at the same production rate. This further determined an equally considerable reduction of $NO_x$ emissions from the pickling solutions.

EXAMPLE 3

This example describes the annealing and pickling process of a ferritic stainless steel strip of the AISI 430 type, 0.7 mm thick and 1270 mm wide, cold-rolled with a reduction rate of 75% and with a surface roughness (Ra) comprised from 0.05 to 0.08 μm. The strip was processed at a process speed of 130 m/min for a production rate of approximately 55 t/h. According to the present invention, the operations were under the following conditions:

heating the strip up to a temperature of 720° C., in an atmosphere with an oxygen content equal to 5% and an average thermal flow directed towards each strip face equal to 50 kW/m$^2$ corresponding to an average heating rate of approximately 31° C./sec. Said heating occurs in a furnace heated by means of free flame burners using methane gas as fuel and oxygen as supporter of combustion adjusted in a 15:1 (air-gas) combustion ratio;

heating the strip in section 2 for 30 s from 720° C. up to the temperature of 890° C. in a gaseous atmosphere formed by nitrogen and having a dew point from 5° C. to −10° C. This heating is performed by means of radiating tubes capable of generating a zone temperature of 900° C. with an installed power (provided by methane/air burners) equal to 6.8 MW;

a cooling step with average rate of 20° C./s up to temperature of 80° C. in a gaseous atmosphere of nitrogen-hydrogen (90%-10%) and having a dew point <−10° C.;

electrolytic descaling in neutral solution of $Na_2SO_4$ with concentration of 180±20 g/l at temperature of 75° C.;

pickling and passivation with nitric acid solutions, with concentration of 100 g/l and HF free at temperature of 30° C.

In these conditions, it was possible to obtain strips with surface reflectivity, measured with an angle of 60°, equal to 49% close to that of strips produced in BA plants, which are in the 46-51% range, and higher than that of strips having equal thickness obtainable with conventional CA&PL process which are in the 30-35% range. The process has allowed to reach a considerably higher productivity with respect to that obtainable in plants of the BA type which is approximately of 20 t/h.

The invention claimed is:

1. A. continuous annealing and pickling process for flat cold-rolled stainless steel products of thickness comprised from 0.3 to 4 mm, having, surface roughness Ra<0.50 μm, comprising the following steps:

a first heating step up to a temperature comprised in the range from 650 to 1050° C. with an average thermal flow from 15 to 300 kW/m$^2$ received by each face of the strip, in a first atmosphere with an oxygen content from 0.5 to 12% provided in a first heating section (1) by means of burners;

a second heating step lasting from 10 to 200 sec up to a temperature comprised in the range from 650 to 1200° C. in a second atmosphere, different with respect to the first atmosphere, with inert agents or reducing agents, said second atmosphere being provided in a second heating section (2) separated from the first heating section (1);

at least one cooling step down to temperatures comprised in the range from 650° C. to ambient temperature in presence of inert agents or reducing agents; and at least one thermochemical or electrolytic descaling step.

2. A process according to claim 1, wherein in the second heating step and in the cooling step if an inert agent is used the inert agent is $N_2$, while if a reducing agent is used the agent is $H_2$.

3. A process according to claim 2, wherein the second heating step is conducted in atmosphere containing $N_2$ whose dew point temperature is comprised in the range from −60 to 10° C.

4. A process according to claim 1, wherein the cooling step is performed in atmosphere containing N2 as inert agent with a dew point temperature from −30° C. to 10° C.

5. A continuous annealing and pickling process for flat cold-rolled stainless steel products of thickness comprised from 0.3 to 4 mm, having surface roughness Ra<0.50 μm, comprising the following steps:

a first heating step up to a temperature comprised in the range from 650 to 1050° C. with an average thermal flow from 15 to 300 kW/m$^2$ received by each face of the strip, in a first atmosphere with an oxygen content from 0.5 to 12% provided in a first heating section (1) by means of burners;

a second heating step lasting from 10 to 200 sec up to a temperature comprised in the range from 650 to 1200° C. in a second atmosphere, different with respect to the first atmosphere, with inert agents or reducing agents, said second atmosphere being provided in a second heating section (2) separated from the first heating section (1);

at least one cooling step down to temperatures comprised in the range from 650° C. to ambient temperature in presence of inert agents and reducing agents; and at least one thermochemical or electrolytic descaling step.

6. A process according to claim 5, wherein in the second heating step and in the cooling step if an inert agent is used the inert agent is $N_2$, while if a reducing agent is used the reducing agent is $H_2$.

7. A process according to claim 6, wherein the second heating step is conducted in atmosphere containing $N_2$ whose dew point temperature is comprised in the range from −60 to 10° C.

8. A process according to claim 1, wherein the cooling step is performed in atmosphere containing mixtures of $N_2$ and $H_2$, with concentrations of $H_2$ comprised in the 0-50% range, said mixtures having a dew point temperature from −60° C. and 10° C.

9. A Process according to claim 8, wherein the cooling step is performed down to temperatures comprised in the range from 550 to 450° C. and in which the thermochemical descaling occurs by means of dissolved salts.

10. A continuous annealing and pickling process for flat cold-rolled stainless steel products of thickness comprised from 0.3 to 4 mm, having surface roughness Ra<0.50 μm, comprising the following steps:

a first heating step up to a temperature comprised in the range from 650 to 1050° C. with an average thermal flow from 15 to 300 kW/m$^2$ received by each face of the strip, in a first atmosphere with an oxygen content from 0.5 to 12% provided in a first heating section (1) by means of burners;

a second heating step lasting from 10 to 200 sec up to a temperature comprised in the range from 650 to 1200° C. in a second atmosphere, different with respect to the first atmosphere, with inert agents and reducing agents, said second atmosphere being provided in a second heating section (2) separated from the first heating section (1);

at least one cooling step down to temperatures comprised in the range from 650° C. to ambient temperature in presence of inert agents or reducing agents; and at least one thermochemical or electrolytic descaling step.

11. A process according to claim 10, wherein in the cooling step if an inert agent is used the inert agent is $N_2$, while if a reducing agent is used the reducing agent is $H_2$.

12. A process according to claim 10, wherein, in the first heating step, up to a temperature of 600° C., the average thermal flow received by each face of the strip is comprised from 150 to 300kW/m$^2$.

13. A process according to claim 12, wherein the second heating step is conducted in atmosphere containing mixtures of $N_2$ and $H_2$ having dew point temperature comprised from −30 to 10° C.

14. A process according to claim 10, wherein the cooling step is performed in atmosphere containing $N_2$ as inert agent with a clew point temperature from −30° C. to 10° C.

15. A continuous annealing and pickling process for flat cold-rolled stainless steel products of thickness comprised from 0.3 to 4 mm, having surface roughness Ra<0.50 μm, comprising the following steps:

a first heating step up to a temperature comprised in the range from 650 to 1050° C. with an average thermal flow from 15 to 300 Kw/m$^2$ received by each face of the strip, in a first atmosphere with an oxygen content from 0.5 to 12% provided in a first heating section (1) by means of burners;

a second heating step lasting from 10 to 200 sec up to a temperature comprised in the range from 650 to 1200° C. in a second atmosphere, different with respect to the first atmosphere, with inert agents and reducing agents, said second atmosphere being provided in a second heating section (2) separated from the first heating section (1);

at least one cooling step down to temperatures comprised in the range from 650° C. to ambient temperature in presence of inert agents and reducing agents; and at least one thermochemical or electrolytic descaling step.

16. A process according to claim 15, wherein in the second heating step and in the cooling step the inert agents are $N_2$ and the reducing agents are $H_2$.

17. A process according to claim 15, wherein, in the first heating step, up to a temperature of 600° C., the average thermal flow received by each face of the strip is comprised from 150 to 300Kw/m$^2$.

18. A process according to claim 3, wherein the second heating step is conducted in atmosphere containing mixtures of $N_2$ and $H_2$ having dew point temperature comprised from −30to 10° C.

* * * * *